US011686148B2

(12) United States Patent
Schweiss

(10) Patent No.: US 11,686,148 B2
(45) **Date of Patent: *Jun. 27, 2023**

(54) LEG FOR A FRAME OF AN OVERHEAD DOOR ASSEMBLY

(71) Applicant: SORREL QUARTERS, LLC, Hector, MN (US)

(72) Inventor: Michael L. Schweiss, Fairfax, MN (US)

(73) Assignee: SORREL QUARTERS, LLC, Hector, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/459,017

(22) Filed: Aug. 27, 2021

(65) Prior Publication Data

US 2021/0388663 A1 Dec. 16, 2021

Related U.S. Application Data

(60) Division of application No. 16/877,068, filed on May 18, 2020, now Pat. No. 11,136,815, which is a continuation-in-part of application No. 15/295,835, filed on Oct. 17, 2016, now Pat. No. 10,669,771, and a continuation-in-part of application No. 29/724,280, filed on Feb. 13, 2020, which is a continuation-in-part of application No. 29/627,432, filed on Nov. 27, 2017, now abandoned.

(51) Int. Cl.

| | |
|---|---|
| ***E06B 3/01*** | (2006.01) |
| ***E05F 15/53*** | (2015.01) |
| ***E06B 3/38*** | (2006.01) |
| ***E05F 15/622*** | (2015.01) |
| ***E06B 1/52*** | (2006.01) |
| *E06B 1/12* | (2006.01) |

(52) U.S. Cl.

CPC ..... *E06B 3/01* (2013.01); *E05F 15/53* (2015.01); *E05F 15/622* (2015.01); *E06B 1/522* (2013.01); *E06B 3/38* (2013.01); *E05Y 2600/45* (2013.01); *E05Y 2900/106* (2013.01); *E05Y 2900/108* (2013.01); *E06B 1/12* (2013.01)

(58) Field of Classification Search

CPC ..... E05F 15/53; E05F 15/622; E06B 3/01; E06B 1/522; E04C 2003/0413

See application file for complete search history.

(56) References Cited

U.S. PATENT DOCUMENTS

| | | | | |
|---|---|---|---|---|
| 523,425 | A * | 7/1894 | Cornell | 211/183 |
| 588,290 | A * | 8/1897 | Poindexter | 52/838 |
| 3,464,161 | A | 9/1969 | Jonsson | |
| 5,375,383 | A | 12/1994 | Lin | |
| 5,647,172 | A | 7/1997 | Rokicki | |

(Continued)

FOREIGN PATENT DOCUMENTS

| | | | |
|---|---|---|---|
| GB | 845429 | * | 8/1960 |

*Primary Examiner* — Gregory J Strimbu
(74) *Attorney, Agent, or Firm* — R. John Bartz

(57) ABSTRACT

A frame for an overhead door has a horizontal header connected to tripod legs with splice assemblies. Each tripod leg has two upright columns connected to an upright I-bar. The splice assemblies connect the upright columns to the header. Hinges pivotally mount the overhead door to the header to allow hydraulic cylinders to selectively move the overhead door between an open position and a closed position.

8 Claims, 13 Drawing Sheets

(56) References Cited

U.S. PATENT DOCUMENTS

| | | | |
|---|---|---|---|
| 6,199,617 | B1 | 3/2001 | Schweiss |
| 6,742,303 | B2 | 6/2004 | Pedemonte |
| 6,866,080 | B2 | 3/2005 | Schweiss |
| 6,883,273 | B2 | 4/2005 | Kerkvliet |
| 8,245,446 | B2 | 8/2012 | Betker |
| 9,528,315 | B2 | 12/2016 | Kim |
| 10,316,576 | B2 | 6/2019 | Schweiss |
| 10,358,860 | B2 | 7/2019 | Schweiss |
| 10,604,991 | B2 | 3/2020 | Schweiss |
| 2002/0029524 | A1 | 3/2002 | Kerkvliet |
| 2008/0086947 | A1 | 4/2008 | Crown |
| 2011/0225895 | A1 | 9/2011 | Peterson |
| 2015/0208798 | A1 | 7/2015 | Glean, II |
| 2017/0367501 | A1 | 12/2017 | Goppion |

* cited by examiner

LEG FOR A FRAME OF AN OVERHEAD DOOR ASSEMBLY

CROSS REFERENCE TO RELATED APPLICATION

This application is a division of U.S. application Ser. No. 16/877,068 filed May 18, 2020, now U.S. Pat. No. 11,136,815. U.S. application Ser. No. 16/877,068 is a continuation-in-part of U.S. application Ser. No. 15/295,835 filed Oct. 17, 2016, now U.S. Pat. No. 10,669,771. U.S. application Ser. No. 15/295,835 is a division of U.S. application Ser. No. 14/751,620 filed Jun. 26, 2015, now U.S. Pat. No. 10,316,576. U.S. application Ser. No. 14/751,620 claims the priority of U.S. Provisional Application Ser. No. 61/998,361 filed Jun. 26, 2014. U.S. application Ser. No. 16/877,068 is also a continuation-in-part of U.S. Design application Ser. No. 29/724,280 filed Feb. 13, 2020. U.S. Design application Ser. No. 29/724,280 is a continuation-in-part of U.S. Design application Ser. No. 29/627,432 filed Nov. 27, 2017.

FIELD OF INVENTION

The invention is in the art relating to doors operable to close and open openings and doorways of buildings. More particularly, the doors are large one-piece overhead doors supported on frames and movable with hydraulic cylinders between closed positions and open positions relative to doorways of buildings.

BACKGROUND OF THE INVENTION

Commercial and industrial buildings, aircraft hangers, farm equipment shop and storage structures, marine and vehicle holding structures, and warehouses have large openings or doorways that are opened and closed with large and heavy doors. Overhead doors are used to maximize useable space of the doorways. Frames are employed to support the overhead doors independently of the building structure. Examples of overhead doors supported on frames and selectively moveable with hydraulic cylinders to open positions and closed positions are identified in the following U.S. patents.

K. O. Jonsson in U.S. Pat. No. 3,464,161 discloses a garage having a swingable door mounted in a building frame comprising two vertical posts. Horizontals support arms secured to the posts are pivotally connected to moveable arms attached to the door. Piston and cylinder units pivotally connected to the support arms and the moveable arms balance the door so that the net force required to open and close the door is small. The entire weight of the door is subjected to the two vertical posts. D. J. Kerkvliet in U.S. Pat. No. 6,883,273 discloses an overhead door pivotally connected to a framework that is separate from a building structure. The framework has a horizontal member secured to vertical members. The vertical members are steel tubes secured with welds to opposite ends of the horizontal member. Hinges pivotally support the overhead door on the horizontal member. Hydraulic cylinders connected to the vertical members and overhead door are operable to move the overhead door between an upright closed position and a horizontal open position. The weight of the overhead door, the wind forces and the hydraulic cylinder forces subjected to the overhead door are transferred to the upright members. D. Crown in U.S. Pat. No. 7,814,952 discloses two hydraulic cylinders mounted on opposite sides of a building door frame operable to open and close an overhead door. Hinges pivotally mount the door to the horizontal member of the door frame. Each hydraulic cylinder is pivotally mounted on the door frame below the axis of rotation of the overhead door and attached to a side edge of the overhead door. The overhead door and the two hydraulic cylinders pivotally connected to the building door frame subject the building door frame to the overhead door weight and the forces of the hydraulic cylinders that move the overhead door between the closed position and the open position. R. W. Betker in U.S. Pat. No. 8,245,446 discloses a tilt-up door support on U-shaped channel members for movement by hydraulic cylinders to a closed position and an open position. The hydraulic cylinders located upright within the U-shaped channel members are anchored to the U-shaped channel members and pivotally connected to the door. The hydraulic cylinders are operable to tilt the door between an upright closed position and a horizontal open position. Upright I-beams are disclosed as supports for a track supporting the tilt-up door. The track controls the tilting movements of the tilt-up door. R. Peterson in U.S. Patent Application Publication No. US2011/0225895 discloses an overhead door pivotally connected with hinges to a horizontal header of a frame. The frame includes upright posts attached to opposite ends of the header that are located adjacent opposite sides of a doorway. The posts are tube stock material. U-shaped channel members secured to the header telescope into the tube posts to connect the header to the posts. Hinges at opposite ends of the header pivotally connect the overhead door to the header. Hydraulic cylinders connected to the posts and overhead door are operable to pivot the overhead door between an upright closed position and a horizontal open position. All the weight of the overhead door and the forces of the hydraulic cylinders that open and close the overhead door are subjected to the upright posts. M. L. Schweiss in U.S. Pat. Nos. 10,316,576, 10,358,860 and 10,604,991 discloses the combination of an overhead door and a frame for supporting the overhead door for movement between an upright closed position and a horizontal open position relative to a doorway of a building. The frame has a horizontal header attached with splice assemblies to two upright columns. Each column is a single upright tubular member. Hinges pivotally connect the overhead door to the header to allow hydraulic cylinders to move the overhead door between the upright closed position and the horizontal open position and allow the overhead door to move from the horizontal open position to the upright closed position. The weight of the over door, wind forces and forces of the hydraulic cylinders on the overhead door are subjected to the two upright columns.

SUMMARY OF THE INVENTION

The frame of the invention supports an overhead door operable to be moved with linear actuators between a generally upright closed position and a generally horizontal open position. The frame has a horizontal header supported by upright tripod legs. Each tripod leg has first and second upright columns connected to an upright I-bar. Connectors attach the tripod legs to opposite ends of the header. The connectors comprise splice assemblies having a first splice assembly fastened to a first upright column and a second splice assembly fastened to a second upright column. Cooperating retainers and fasteners align the tripod legs with the header and maintain the columns straight, flush and in the same upright plane of the header. A plurality of hinge assemblies pivotally connect upright members of the door frame to the header. Linear actuators, such as hydraulic cylinders or motor driven screws, connected to the door and tripod legs operate to swing the door between an upright closed position and a generally horizontal open position and allow the door to move from the generally horizontal open position to the upright closed position. The frame supports the weight of the door and absorbs wind forces and the forces subjected to the door by the linear actuators during the opening and closing of the door thereby eliminating most if not all weight and forces on the adjacent building structure. Each splice assembly has an upright body having a wall and opposite end edges. A plurality of upright ribs attached to the body are retained in a flat surface engagement with a column by adjustable fasteners connecting the column to the body. The fasteners include nuts secured to the body and bolts mounted on the column engageable with the nuts. In use, the bolts are turned to move the columns into alignment with the header and secure the columns to the splice assemblies. A plurality of second adjustable fasteners comprise cooperating nuts and bolts. The bolts engage an edge of the body to hold the opposite edge of the body in engagement with the columns concurrently with the engagement of the ribs with the columns. The first and second adjustable fasteners retain the splice assemblies in engagement with the perpendicular walls of the columns. The hinge assemblies have sleeves rotatably mounted on non-rotatable pins. The sleeves are connected with arms to the upright members of the door frame. Header members or supports adjacent the sleeves are secured to the header whereby the hinge assemblies support the door on the header of the frame for movement of the door between open and closed positions and absorb the forces of the linear actuators that move the door between the closed position and the open position. The tripod legs provide the frame with lateral and vertical strength and stability required for large and heavy metal overhead doors.

DETAILED DESCRIPTION OF THE OVERHEAD DOOR

Figure 1:
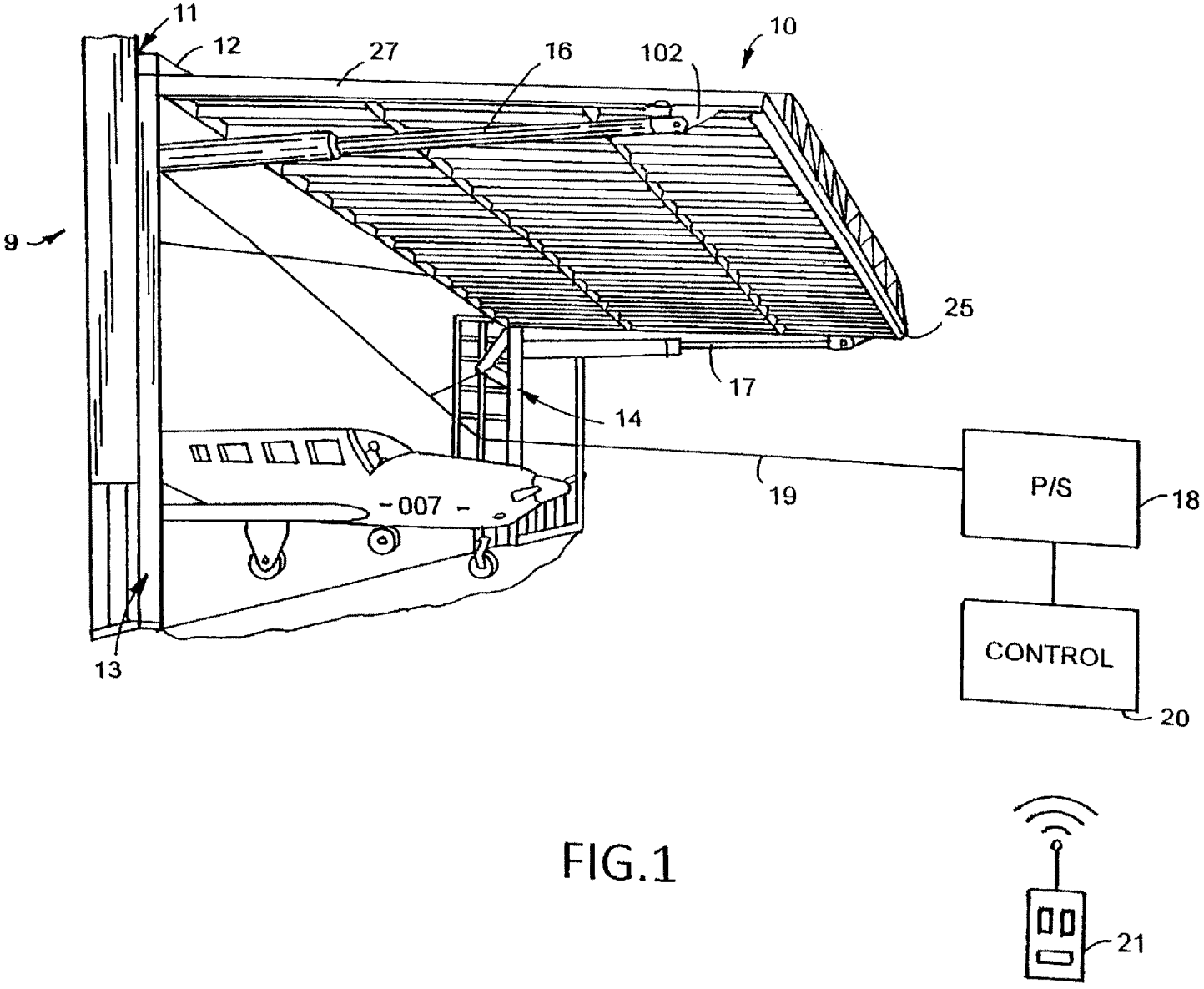
FIG. 1 is a perspective view of a building equipped with an open overhead door pivotally attached to a frame operable to open and close a doorway of the building.

A building 9, shown in FIG. 1, includes a doorway or an upright opening to allow vehicles and equipment to move into and out the interior of the building. Examples of building 9 include aviation hangers, automotive shops, farm and ranch shops, commercial retail and marine buildings, warehouses and manufacturing plants. An overhead door 10 pivotally mounted on a frame assembly 11 is movable in an arcuate path between a horizontal open position, shown in FIG. 1, to an upright closed position, shown in FIG. 2. Linear actuators 16 and 17, shown as hydraulic piston and cylinder mechanisms, are operable to move overhead door 10 between the open and closed positions and hold the door in these positions. A hydraulic fluid pump unit 18 connected with fluid accommodating lines 19 to the dead ends of the piston and cylinder mechanisms 16 and 17 function to supply hydraulic fluid under pressure to control the operation of the piston and cylinder mechanisms 16 and 17 whereby overhead door 10 is selectively moved between the open and closed positions. A control 20 coupled to pump unit 18 is manually operable to regulate the operation of pump unit 18. A remote actuator 21 can also be used to regulate control 20. An example of a hydraulic fluid system for an overhead door associated with hydraulic cylinders is disclosed in U.S. Pat. No. 6,883,273. A linear actuator having a motor operating a screw is disclosed in U.S. Pat. No. 6,742,303.

Figure 2:
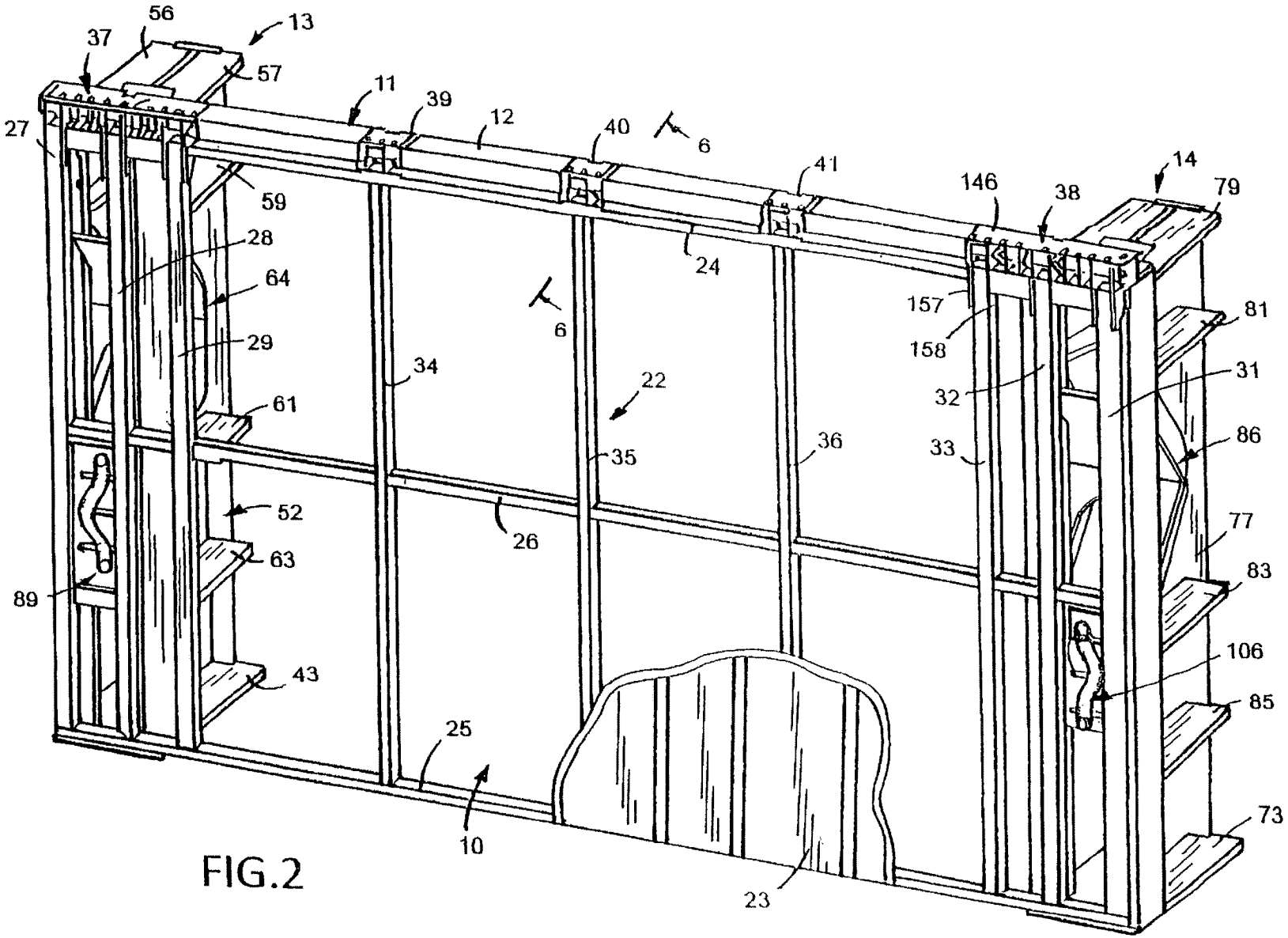
FIG. 2 is an enlarged perspective view of a closed overhead door and frame of FIG. 1.

As shown in FIG. 2, door 10 has a rectangular door frame 22 supporting sheathing and trim 23. Door frame 22 comprises tubular metal top and bottom horizontal members 24 and 25. A horizontal middle member 26 is located between members 24 and 25. Left side upright members 27, 28 and 29 are secured with welds to horizontal members 24, 25 and 26. Right side upright members 31, 32 and 33 are secured with welds to the horizontal members 24, 25 and 26. Upright members 34, 35 and 36 located between the end members 29 and 33 reinforce door 10. Door frame 22 is tubular steel bars welded together. The door frame members can be aluminum or composite materials. Large metal doors have a large amount of weight which require large forces to move the doors between open and closed positions. The frames supporting the doors must have adequate strength to accommodate heavy overhead doors and wind forces directed to the doors.

Figure 7:
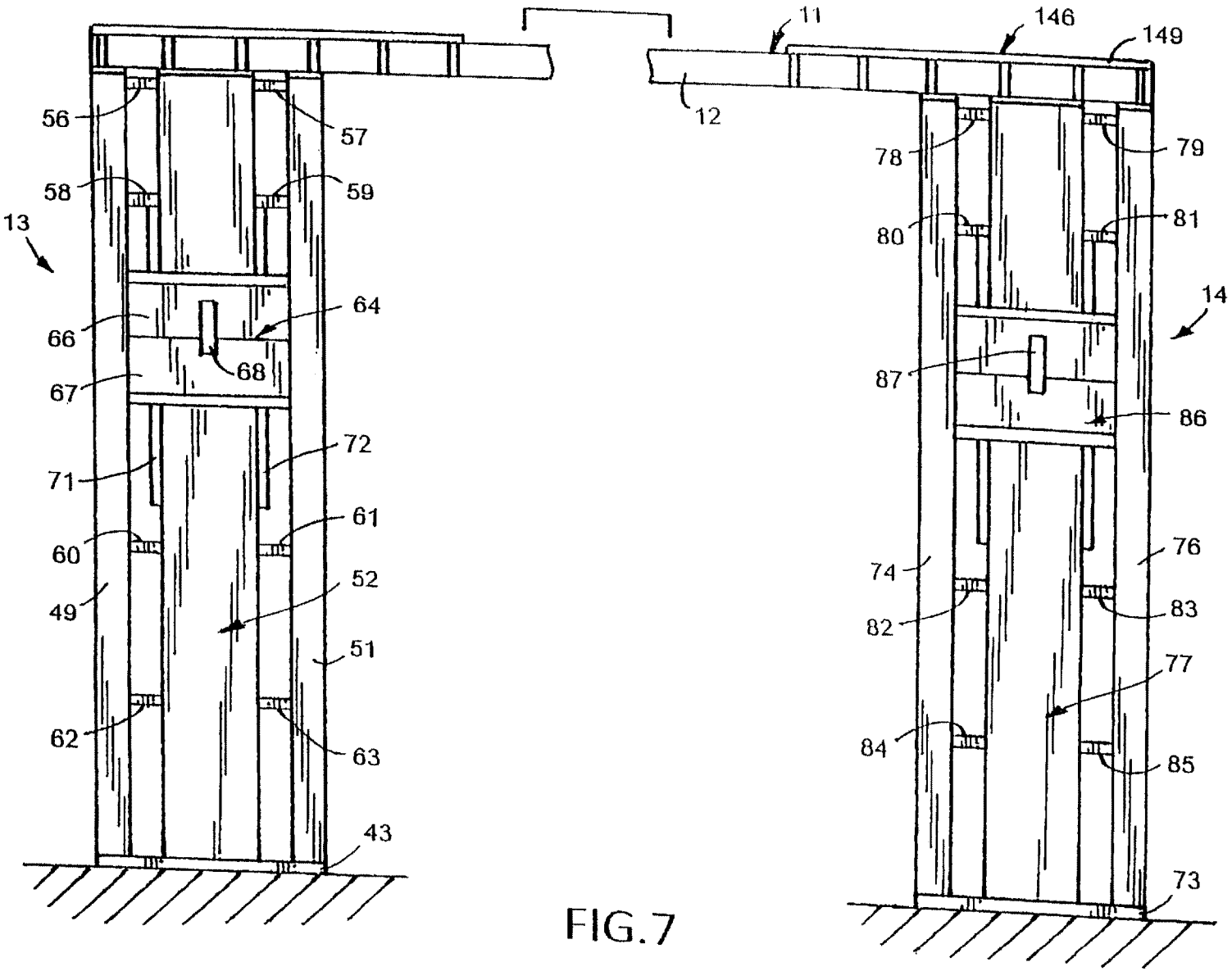
FIG. 7 is a foreshortened front elevational view of the frame of FIG. 2.
Figure 8:
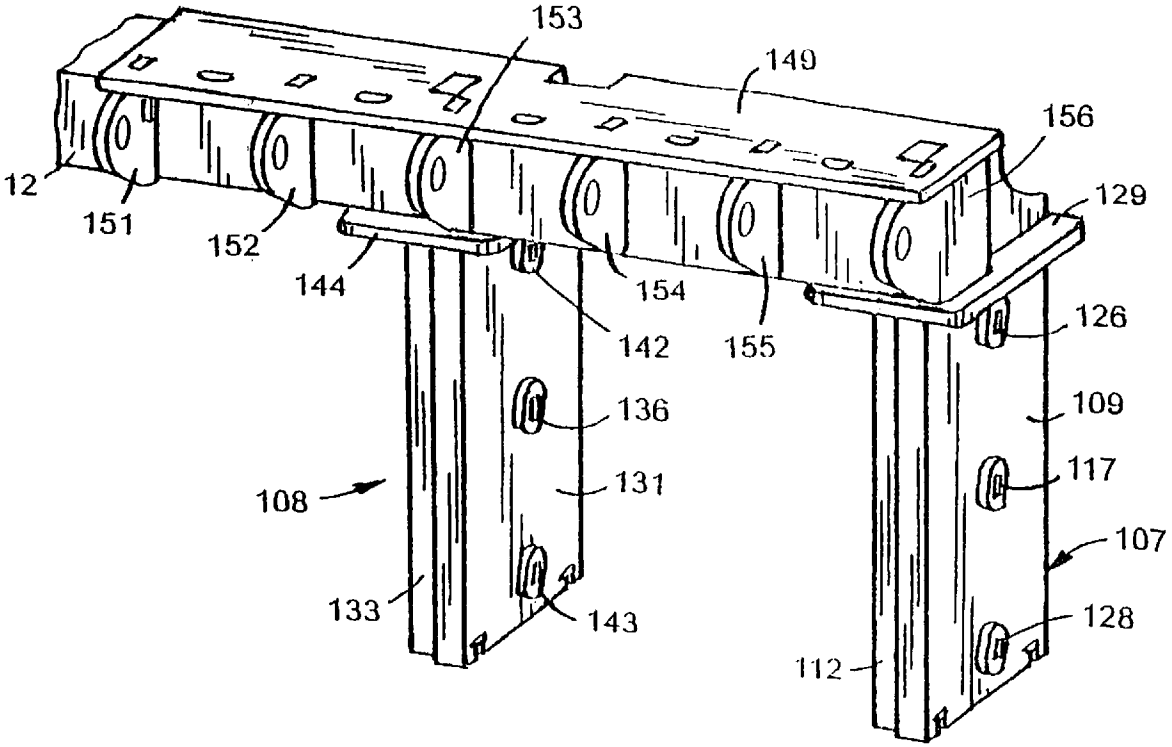
FIG. 8 is a perspective view of the double splice assemblies of the frame.
Figure 9:
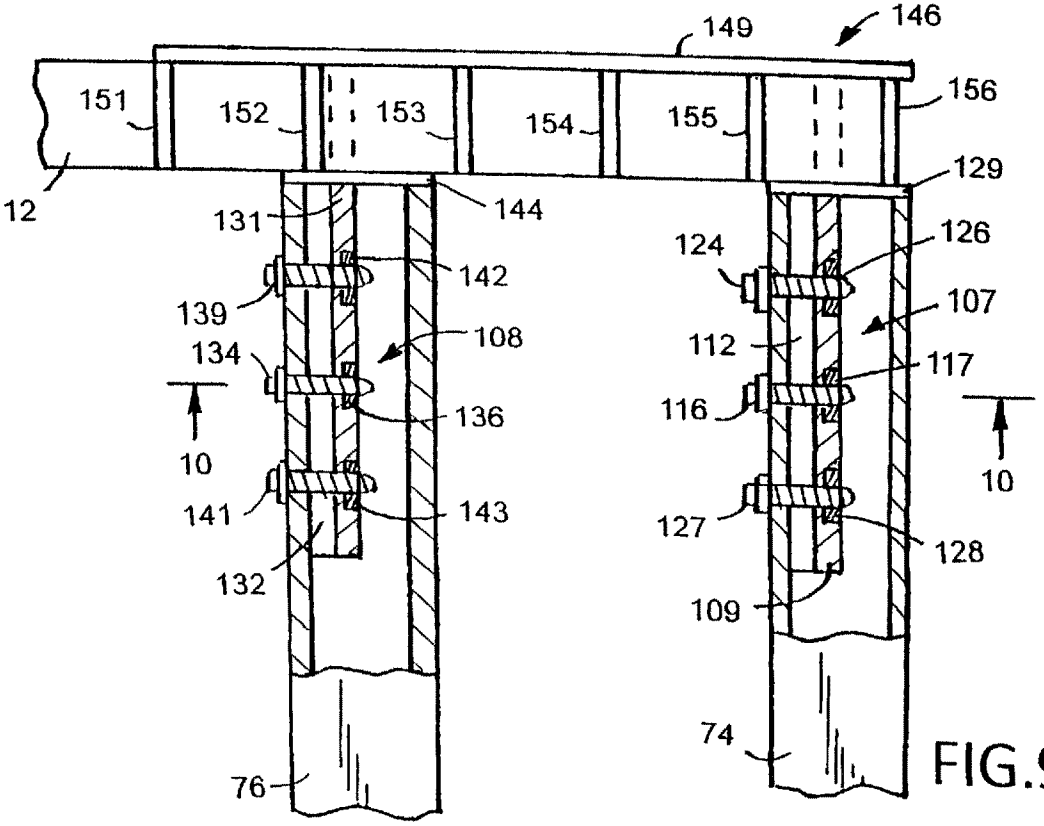
FIG. 9 is a front elevational view, partly sectioned, of the double splice assemblies secured to the upright columns of a tripod leg.
Figure 10:
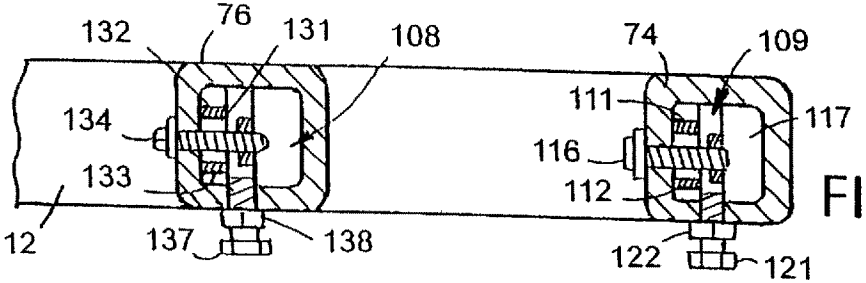
FIG. 10 is a sectional view taken along line 10-10 of FIG. 9.
Figure 11:
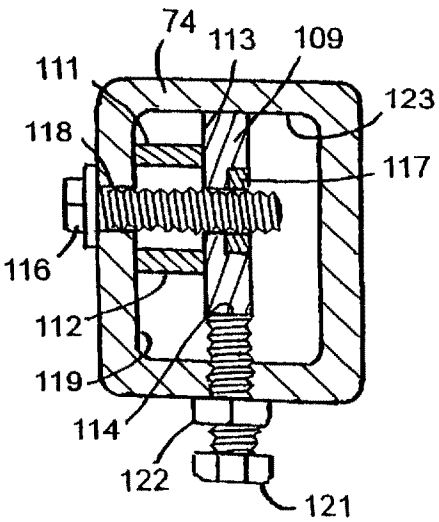
FIG. 11 is an enlarged sectional view of a splice assembly connected to an upright column of a tripod leg.
Figure 12:
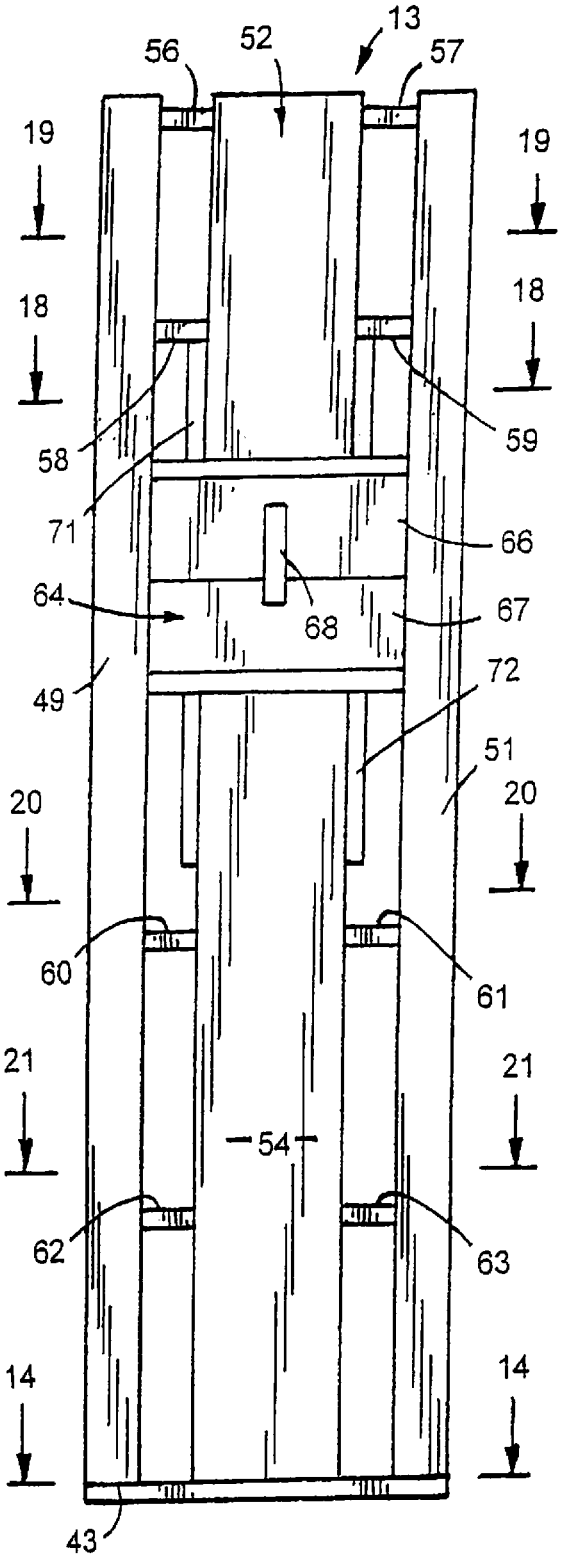
FIG. 12 is a front elevational view of a tripod leg of the frame of FIG. 7.
Figure 13:
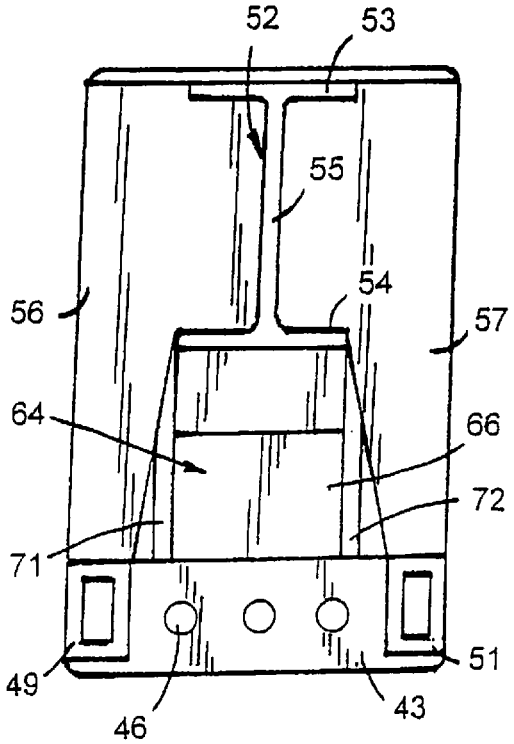
FIG. 13 is a top plan view of FIG. 12.
Figure 14:
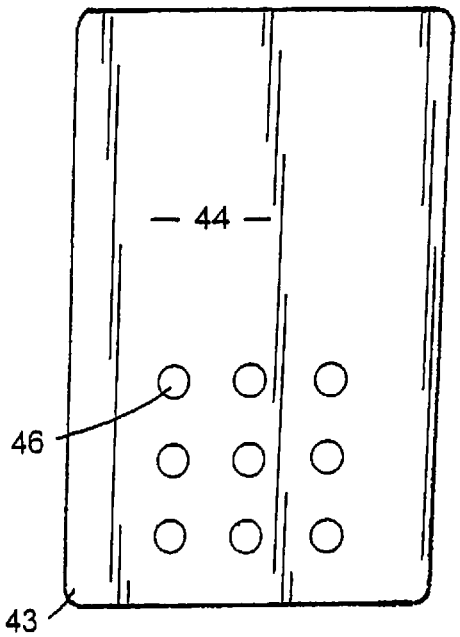
FIG. 14 is a sectional view taken along line 14-14 of FIG. 12.
Figure 15:
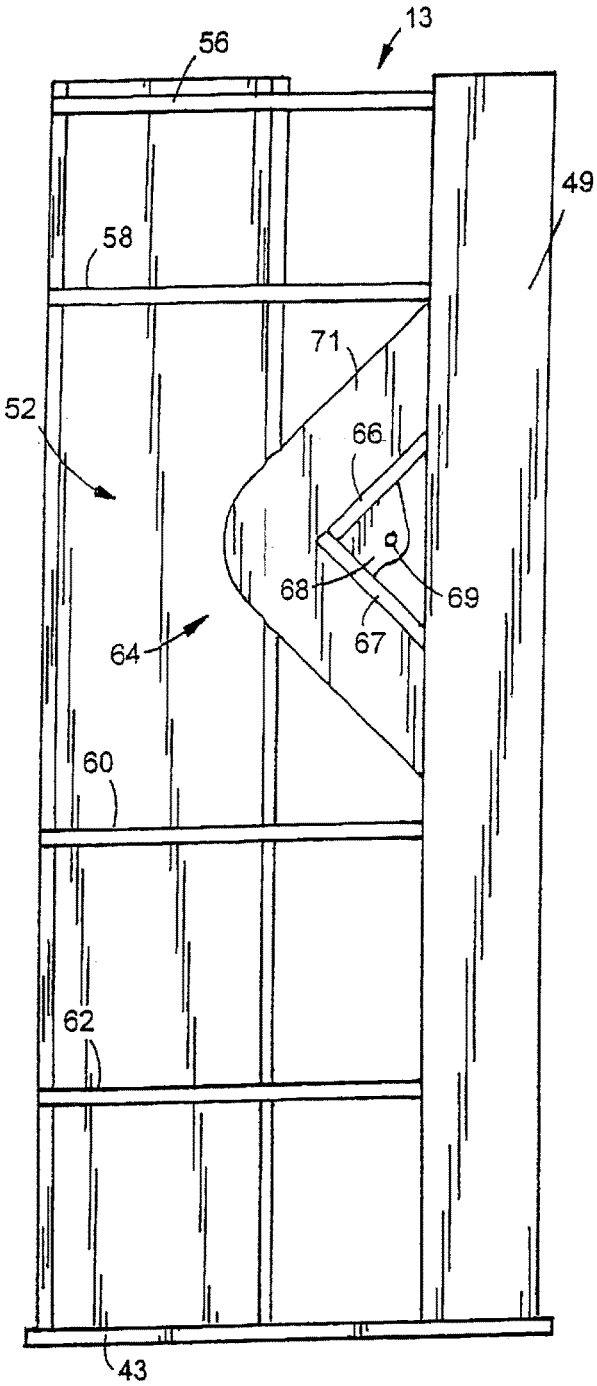
FIG. 15 is a left side elevational view of the tripod leg of FIG. 12.
Figure 16:
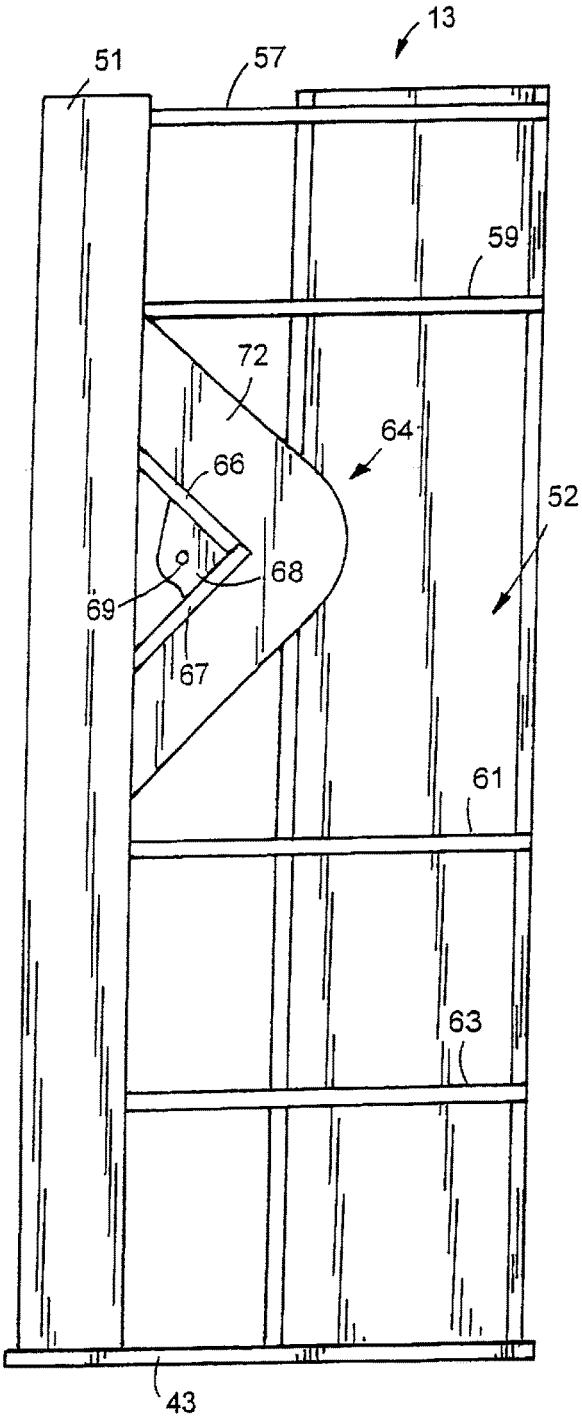
FIG. 16 is a right side elevational view of the tripod leg of FIG. 15.

Frame 11, shown in FIG. 7, has a horizontal header 12 extended between and attached to upright tripod legs 13 and 14. Header 12 is a linear tubular steel beam having opposite end sections mounted on tripod legs 13 and 14. As shown in FIG. 2, a first hinge assembly 37 mounted on header 12 in alignment with tripod leg 13 is connected to upright door frame members 27, 28 and 29. A second hinge assembly 38 is also mounted on header 12 in alignment with tripod leg 14. Hinges 39, 40 and 41 are mounted on header 12 between the first and second hinge assemblies 37 and 38. Hinge assemblies 37 and 38 and hinges 39, 40 and 41 have a common horizontal axis allowing door 10 to be moved by linear actuators 16 and 17 between the upright closed position and the horizontal open position.

Figure 3:
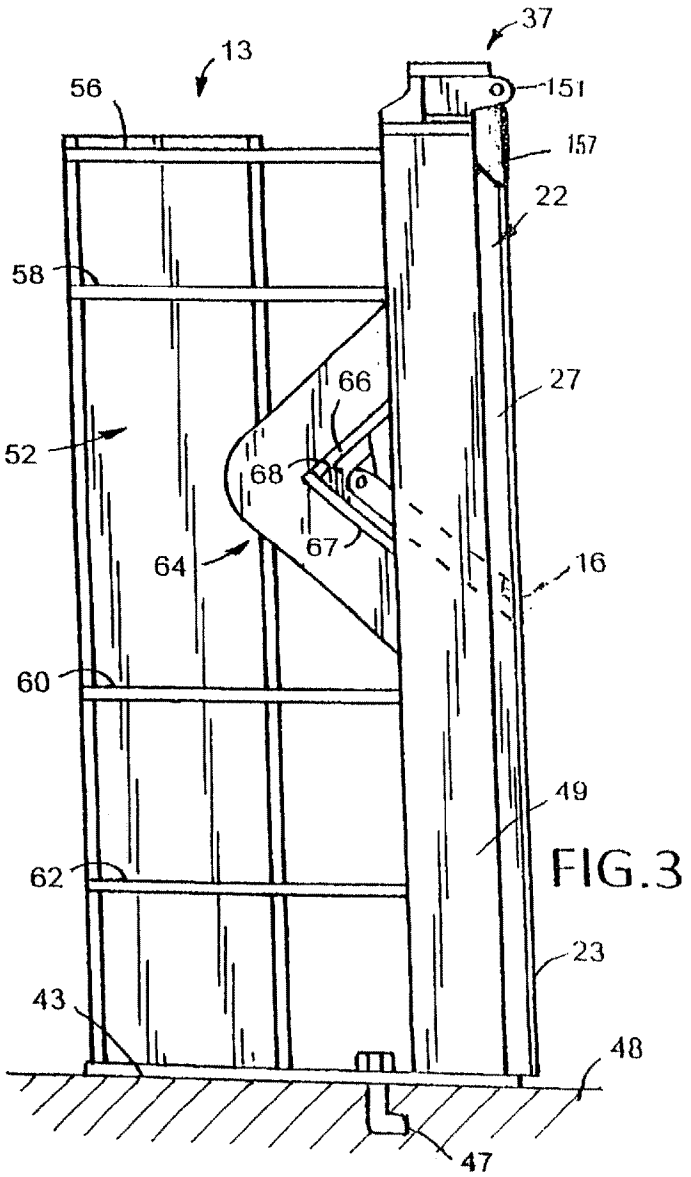
FIG. 3 is a left side elevational view of FIG. 2.
Figure 17:
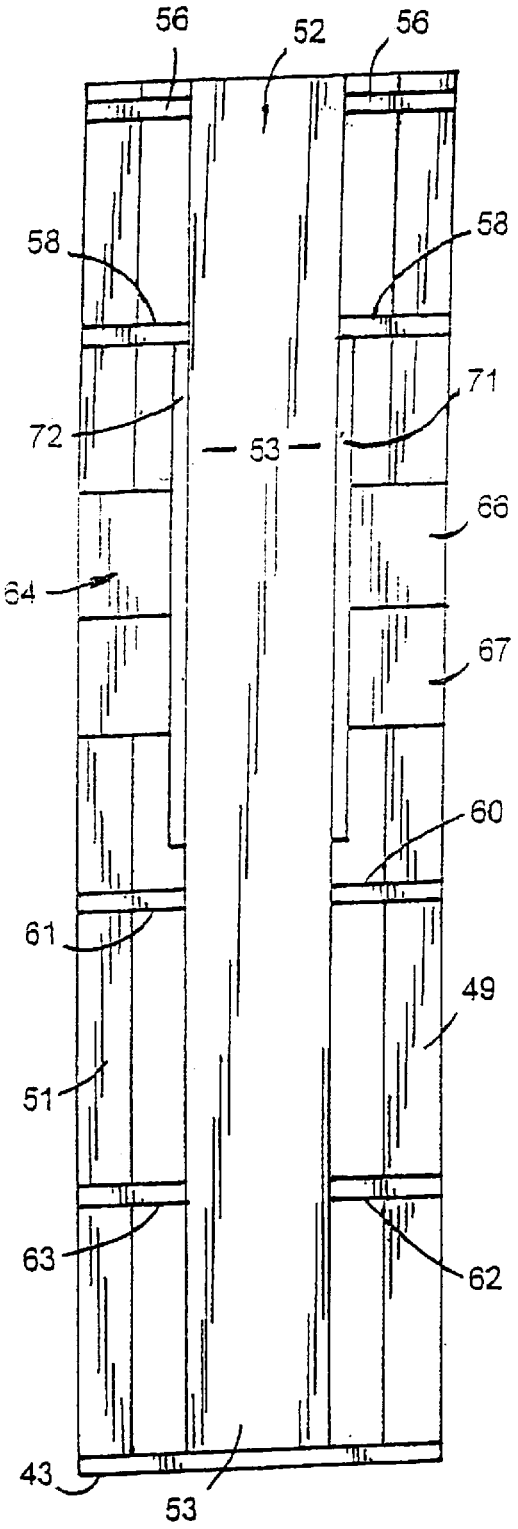
FIG. 17 is a rear elevational view of the tripod leg of FIG. 15.
Figure 18:
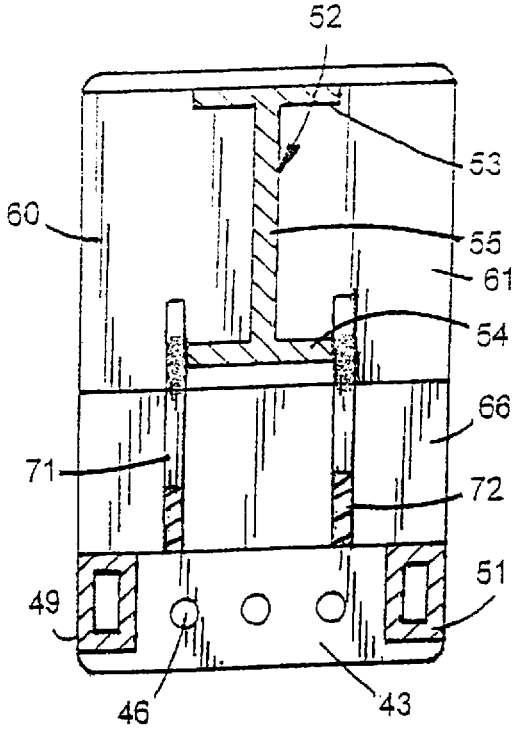
FIG. 18 is a sectional view taken along line 18-18 of FIG. 12.
Figure 19:
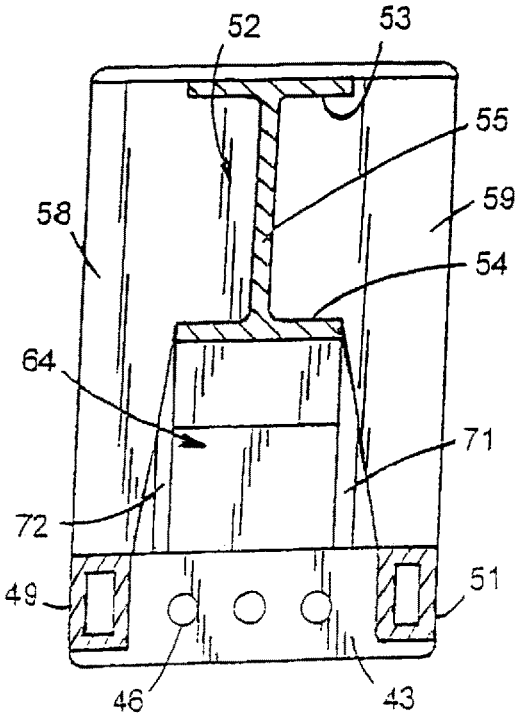
FIG. 19 is a sectional view taken along line 19-19 of FIG. 12.
Figure 20:
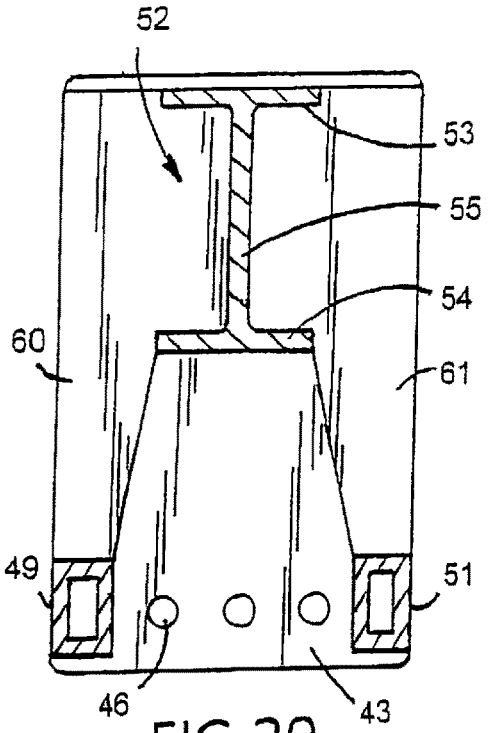
FIG. 20 is a sectional view taken along line 20-20 of FIG. 12.
Figure 21:
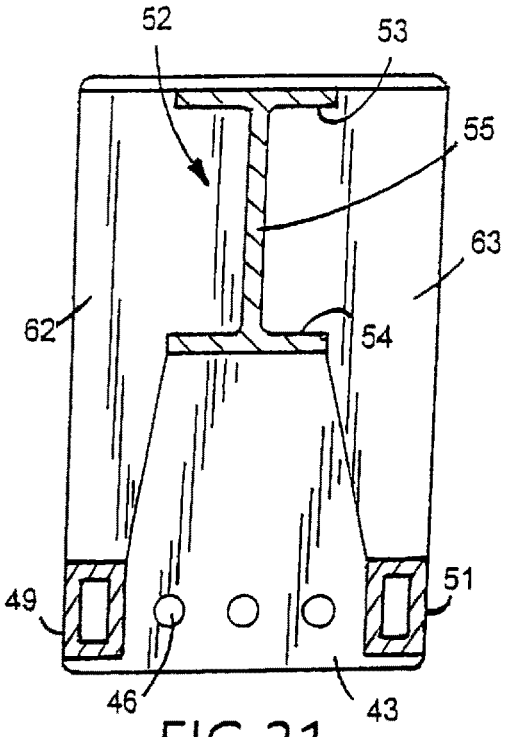
FIG. 21 is a sectional view taken along line 21-21 of FIG. 12.

Tripod leg 13, shown in FIGS. 12 to 21, comprises a base 43 adapted to be secured to a support or floor 48 of building 9. Base 43 is a flat rectangular metal plate having a top wall 44 and a plurality of holes 46. Anchors 47, shown in FIGS. 3 and 4, extend through holes 46 to secure base 43 to floor 48. Returning to FIGS. 12 to 21, tripod leg 13 has a first upright tubular column 49 and a second upright tubular column 51. Columns 49 and 51 are laterally spaced from each other and secured with welds to the front corners of the front section of base 43. An upright I-bar 52 is secured with welds to the middle of the rear section of base 43. Columns 49 and 51 and I-bar 52 have the same upright dimensions and are in parallel triangular orientation. I-bar 51 is an upright I-beam having lateral flanges 53 and 54 jointed with a flat cross member 55. A number of horizontal plates 56, 57, 58, 59, 60, 61, 62 and 63 are vertically spaced between columns 49 and 51 and I-bar 52. Welds secure each plate 56 to 63 to columns 49 and 51 and I-bar 52. A support assembly 64 for linear actuator 16 is located between upright columns 49 and 51 and I-bar 52. Support assembly 64 has flat transverse members 66 and 67 secured together in a right angle shape with the space between members 66 and 67 open to columns 49 and 51. As shown in FIGS. 17 and 18, members 66 and 67 engage columns 49 and 51. Welds secure members 66 and 67 to columns 49 and 51. A rib or connecting device 68 secured to the inside center of members 66 and 67 has a hole 69 to accommodate a pin 104 connecting the dead end of linear actuator 16 to rib 68. Second and third ribs or right angle flanges 71 and 72 secured to the rear surfaces of members 66 and 67 reinforce members reinforce members 66 and 67. As shown in FIGS. 17 and 18, ribs 71 and 72 are also secured to flange 54 of I-bar 52.

Figure 4:
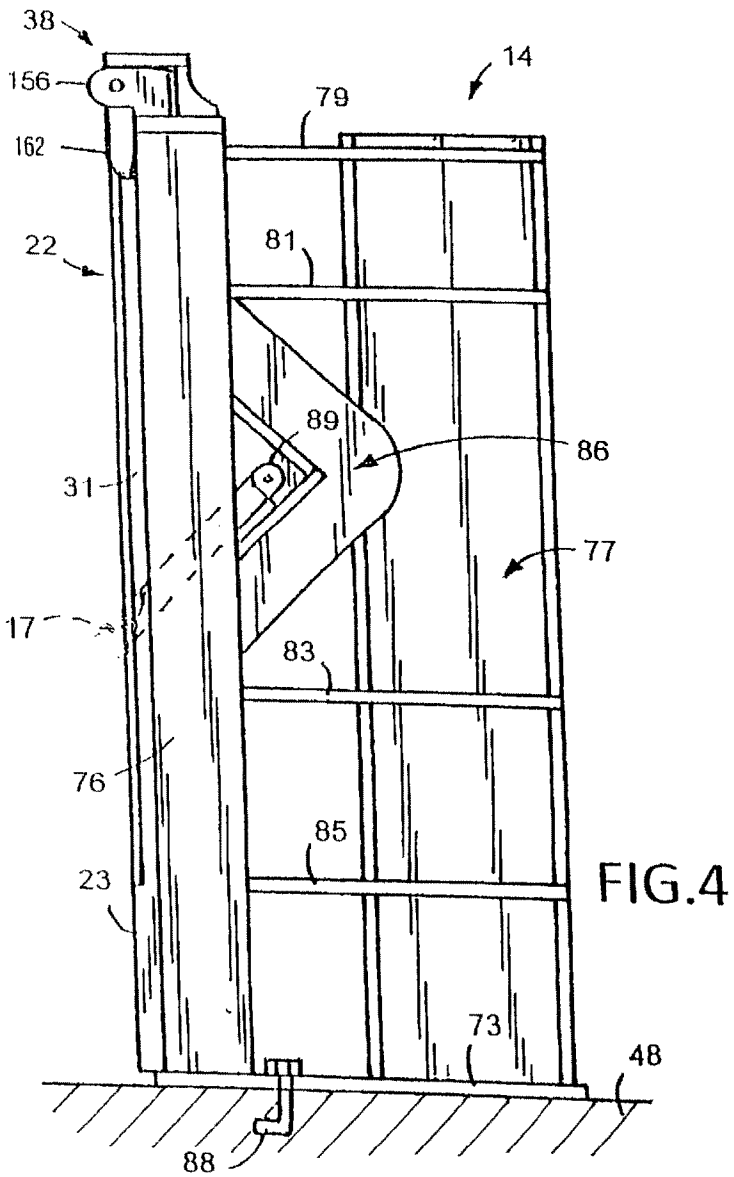
FIG. 4 is a right side elevational view of FIG. 2.

The second tripod leg 14, shown in FIGS. 2, 4 and 7, has the same structure as tripod leg 13. Tripod leg 14 has a base 73 supporting first and second upright tubular columns 74 and 76 and an I-bar 77. Plates 78, 79, 80, 81, 82, 83, 84 and 85 secure columns 74 and 76 to I-bar 77. Columns 74 and 76 and I-bar 77 hold a support assembly 86 for retaining linear actuator 17. A rib 87 on the front center of support assembly 86 accommodates a pin that connects linear actuator 17 to rib 87. An anchor 88 secures base 78 to floor 48.

Figure 23:
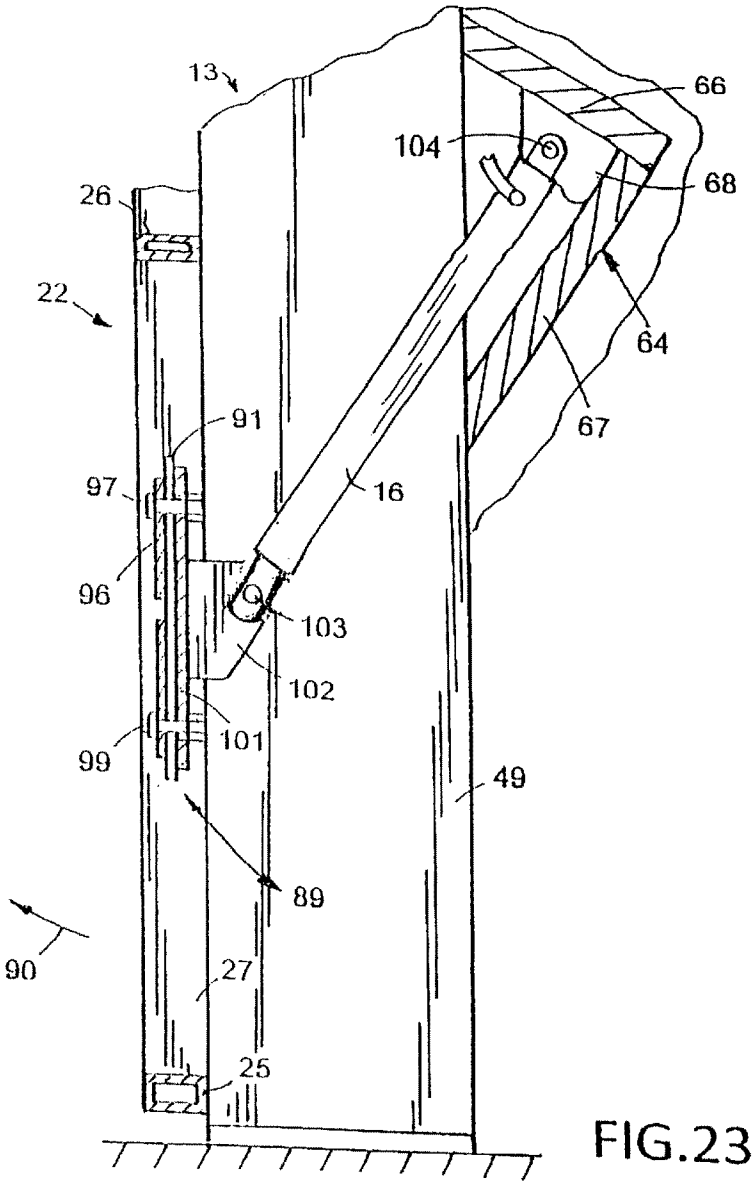
FIG. 23 is an enlarged sectional view taken along line 23-23 of FIG. 22.
Figure 22:
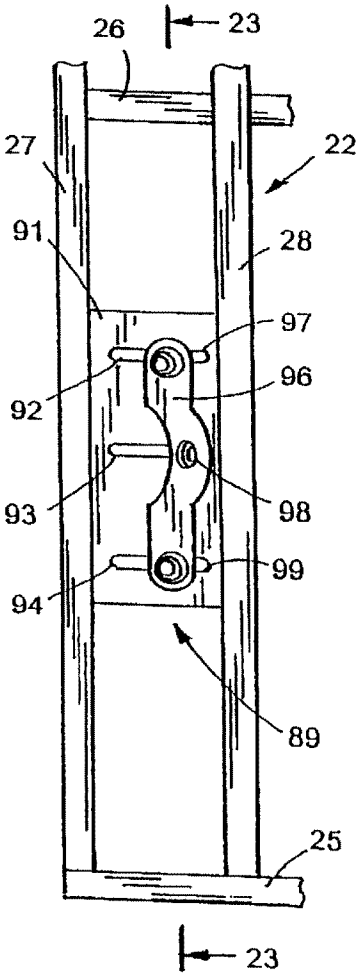
FIG. 22 is an enlarged elevational view of a lower corner section of the door frame.

Proceeding to FIGS. 22 and 23, linear actuator 16 extended between support assembly 64 and a mount 89 is operable to pivot door 22, shown by arrow 90, between an upright door closed position and a horizontal door open position. Mount 89 comprises a flat first plate 91 located between upright door frame members 27 and 28. Welds secure plate 91 to door frame members 27 and 28 whereby the forces of linear actuator 16 are imparted to both door frame members 27 and 28. Plate 91 has three vertically spaced horizontal openings or slots 92, 93 and 94. A bar 96 is located in surface contact with the front of plate 91. A second plate 101 engages the back surface of plate 91. An arm 102 secured to plate 101 accommodates a pin 103 operable to pivotally connect linear actuator 16 to arm 102. A plurality of fasteners 97, 98 and 99, shown as nut and bolt assemblies, extended through slots 92, 93 and 94 clamp bar 96 and plate 101 to plate 91. The second plate 101 and arm 102 are laterally adjustable relative to the first plate 91 to align linear actuator 16 relative to support assembly 64. A second mount 106 secured to door upright members 31 and 32, shown in FIG. 2, has the same structure and functions including the horizontal adjustment as mount 89. Mount 106 is also pivotally connected to linear actuator 17 connected to second tripod leg 14.

Frame 11 has first splice assemblies 107 and 108, shown in FIGS. 8 to 11, that secures tripod leg 14 to header 12. Second splice assemblies secure tripod leg 13 to header 12. The splice assemblies have the same structures and functions.

Splice assembly 107 has a body 109 comprising a flat upright member supporting a pair of upright ribs 111 and 112. Ribs 111 and 112 have flat end surfaces located in surface engagement with a first inside wall 119 of column 74 of tripod leg 14. Body 109 has a first end 113 located in engagement with a second inside wall 123 of column 74. A fastener 116, shown as a threaded bolt, cooperates with a nut 117 retained on body 109 to hold ribs 111 and 112 in upright surface engagement with inside wall 119 of column 74. A second fastener 121, shown as a threaded bolt, extends through a nut 122 secured to column 74. The distal end of fastener 121 engages second end 114 of body 109 and forces first end 113 of body 109 into engagement with second inside wall 123 of column 74. A fastener 124 cooperates with a nut 126 on body 109 and a third fastener 127 cooperating with a nut 128 on body 109 operates in concert with fastener 116 to retain ribs 111 and 112 in surface engagement with inside wall 119 of column 74. A plat 129 secured to body 109 and ribs 111 and 112 is fixed by welds to header 12.

Splice assembly 108 has an upright body 131 supporting a pair of upright ribs 132 and 133. Fasteners 134, 139 and 141 retained on column 76 cooperate with nuts 136, 142, 143 concurrently hold ribs 132 and 133 in upright surface engagement with a first inside wall of column 76. An additional fastener 139 threaded through a nut 138 secured to column 76 has a distal end that contacts body 131 and holds body 131 in engagement with a second inside wall of column 76. Body 131 and ribs 132 and 133 are secured to a plate 144. Welds secure plate 144 to header 12. Splice assemblies 107 and 108 are laterally spaced apart and telescope into the upper ends of tubular columns 74 and 76 of tripod leg 14. Fasteners 116, 124 and 127 secure splice assembly to column 74. Fasteners 134, 139 and 141 secure splice assembly 108 to column 76.

Figure 5:
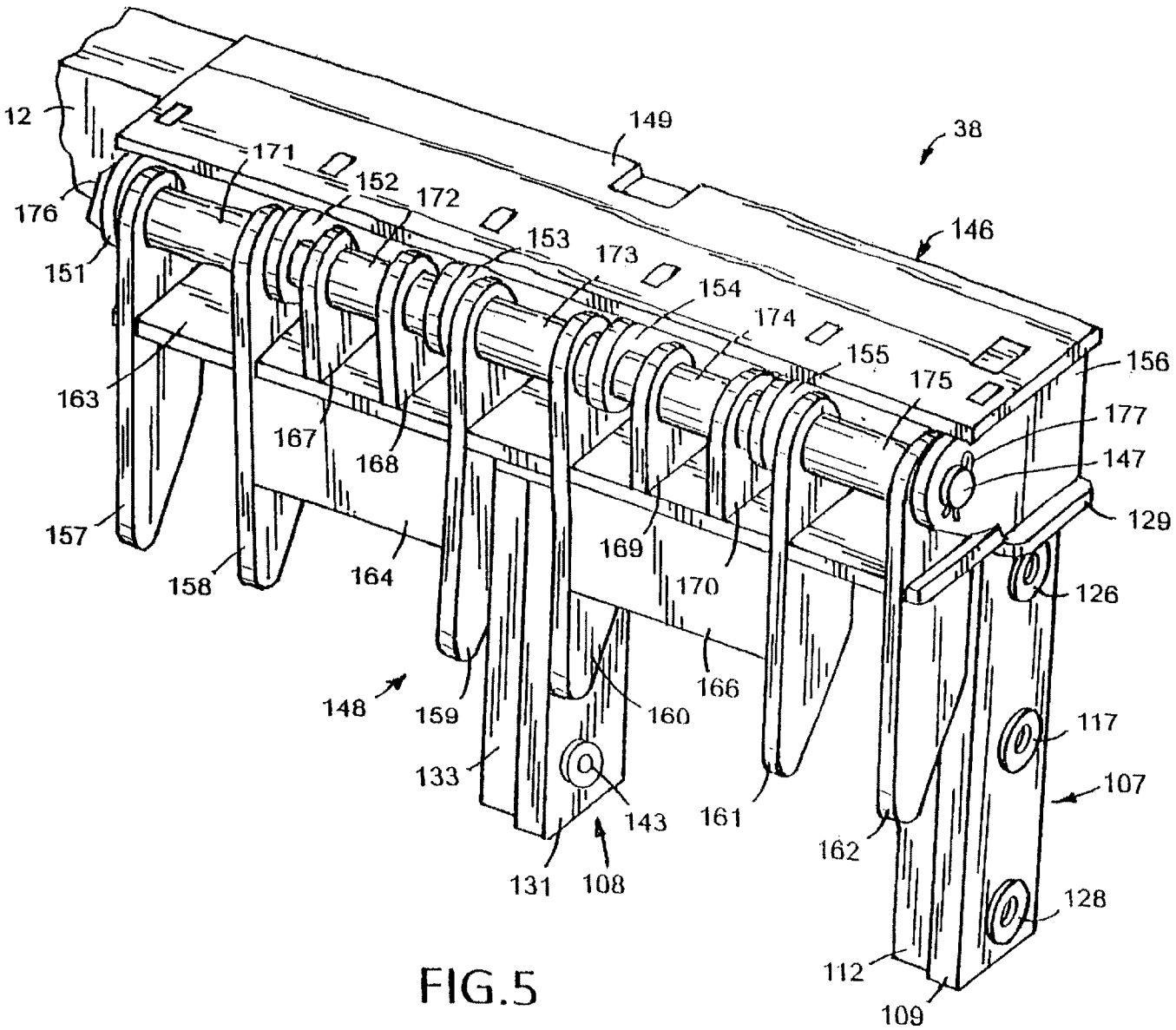
FIG. 5 is a perspective view of the hinge assembly pivotally connecting the door frame to the header of the frame.

Hinge assembly 38, shown in FIG. 5, comprises a frame unit 146 pivotally connected with a horizontal pin 147 to a door frame unit 148. Frame unit 146 has a horizontal plate 149 secured with welds to the top surface of header 12. A plurality of vertical supports 151, 152, 153, 154, 155 and 156 are secured with welds to the bottom of plate 149. Adjacent supports are laterally spaced apart. First vertical members 157 and 158 located between supports 151 and 152 extend downward on opposite sides of door frame member 33. Second vertical members 159 and 161 located between supports 153 and 154 extend downward on opposite side of door frame member 32. Third vertical members 161 and 162 extend downward adjacent door frame member 31. Welds secure members 157, 158, 159, 160, 161 and 162 to door frame members 33, 32 and 31. Horizontal plates 163 secured to vertical members 157, 158, 159, 160, 161 and 162 retain vertical members 157, 158, 159, 160, 161 and 162 in lateral spaced relationship. Plates 163 also support arms 167, 168, 169 and 170 located between the upper sections of vertical members 158, 159, 160 and 161. Arms 167, 168, 169 and 170 have openings that accommodate cylindrical members or sleeves 171, 172, 173, 174 and 175. Pin 147 extended through supports 151 to 156, the upper sections of vertical members 157 to 162, and sleeves 171 to 175 pivotally connects frame unit 146 to door frame unit 148 and supports an end of overhead door 10. A block 176 secured to support 151 functions to prevent pin 147 from rotating during the opening and closing of overhead door 10. A retainer 177, shown as a cotter key, on the end of pin 147 opposite block 176 limits axial movements of pin 147 relative to supports 151 to 156.

Hinge assembly 37 mounted on the end of header 12 opposite hinge assembly 38 has the same structure and function as hinge assembly 38. Hinge assemblies 37 and 38 are concurrently operative to support overhead door 10 on frame 11 and allow overhead door 10 to be moved with linear actuators 16 and 17 from a door closed position and a door open position. Hinge assemblies 37 and 38 also support overhead door 10 in the open position on frame 11.

Figure 6:
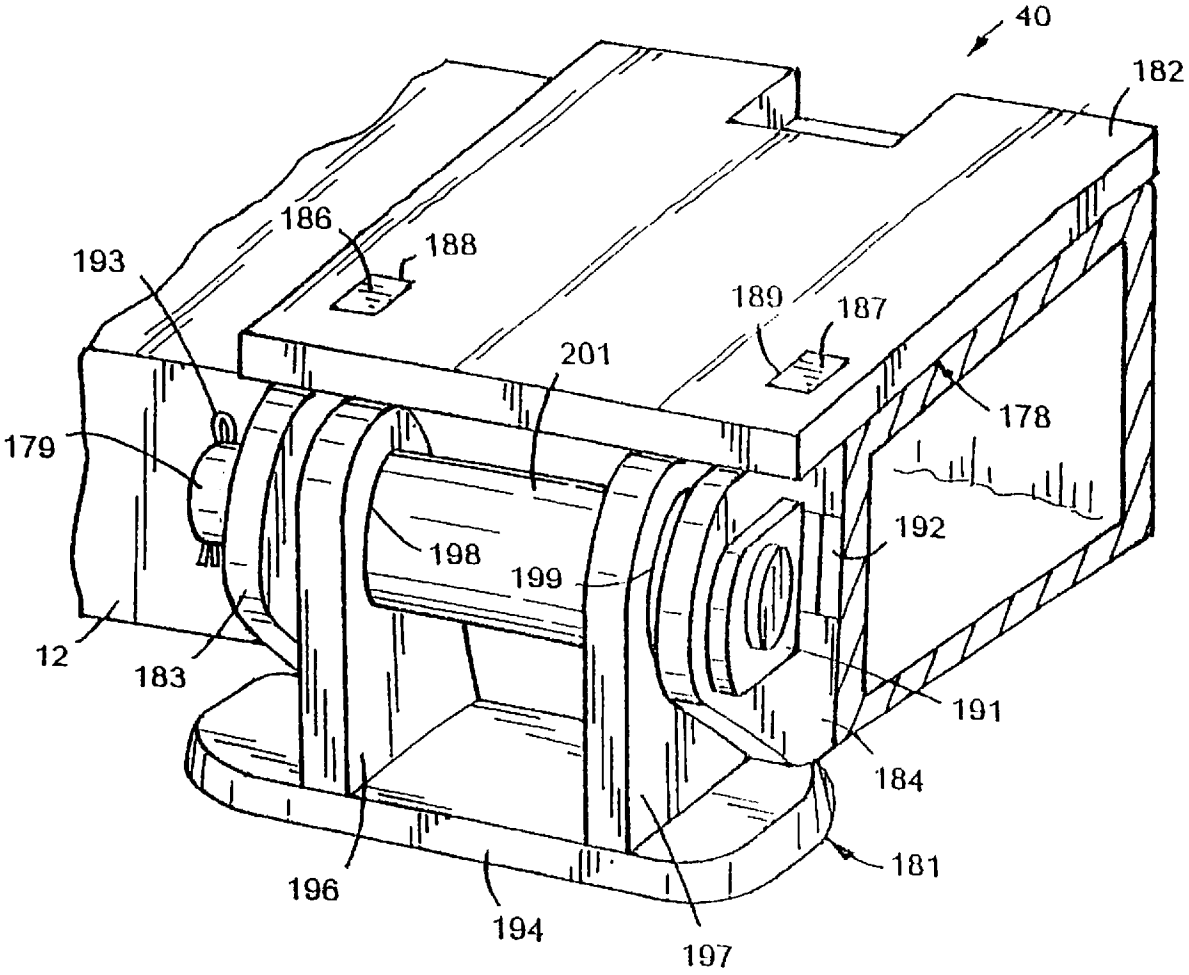
FIG. 6 is an enlarged sectional view taken along line 6-6 of FIG. 2.

Proceeding to FIG. 6, hinge 40 along with hinges 39 and 41 support door frame 22 between end hinge assemblies 37 and 38. Hinges 39, 40 and 41 have the same structure and functions. Hinge 40 is herein described as having a frame unit 178 connected with a horizontal pin 179 to a door frame unit 181. Frame unit 178 comprises a horizontal plate 194 secured with welds to the top surface of header 12 of frame 11. A pair of supports 183 and 184 extended vertically below plate 182 are secured to the bottom of plate 182. Door frame unit 181 has a plate 194 secured with a weld to top member 24 of door frame 22. Upright arms 196 and 197 secured to plate 194 are located adjacent the inside walls of supports 183 and 184. A cylindrical member or sleeve 201 extends through openings 198 and 199 in arms 196 and 197. Pin 179 extended through sleeve 201 and supports 183 and 184 pivotally connects door frame unit 181 to frame unit 178 and supports overhead door 10 on header 12 of frame 11. Pin 179 does not rotate during the pivoting of overhead door 10 between the open position and the closed position. Sleeve 201 has a large inside cylindrical surface that engages pin 179 and distributes forces along the length of pin 179 to reduce wear and shearing of pin 179. A block 191 secured to a first end of pin 179 engages a stop 172 secured to support 184 to prevent rotation of pin 179 relative to frame unit 178. The second end of pin 179 accommodates a retainer 193, shown as a cotter key, to limit axial movement of pin 179 relative to supports 196 and 197.

The foregoing drawing and description of the overhead door and frame with tripod legs and splice assemblies is one embodiment of the invention. Persons skilled in the art of overhead doors can make changes and modifications of the structures and materials to the door, the frame and the hinges without departing from the door, the frame and the tripod leg defined in the claims.

The invention claimed is:

1. An overhead door and frame comprising:

hinges connected to the overhead door and the frame for supporting the overhead door on the frame for movement between a generally horizontal open position and an upright closed position, the frame comprising a header having a first end and a second end opposite the first end, a first tripod leg connected to the first end of the header and a second tripod leg connected to the second end of the header, said first tripod leg comprising a first base, a first upright tubular column secured to the first base, a second upright tubular column secured to the first base and a first upright I-bar secured to the first base, said second upright tubular column being parallel to the first upright tubular column and laterally spaced from the first upright tubular column, said first upright I-bar being spaced from the first upright tubular column and spaced from the second upright tubular column, at least one first transverse member secured to the first upright tubular column and secured to the second upright tubular column, at least one first rib secured to the at least one first transverse member and the first upright I-bar for connecting the at least one first transverse member to the first upright I-bar, said second tripod leg comprising a second base, a third upright tubular column secured to the second base, a fourth upright tubular column secured to the second base and a second upright I-bar secured to the second base, said fourth upright tubular column being parallel to the third upright tubular column and laterally spaced from the third upright tubular column, said second upright I-bar being spaced from the third upright tubular column and spaced from the fourth upright tubular column, at least one second transverse member secured to the third upright tubular column and secured to the fourth upright tubular column, at least one second rib secured to the at least one second transverse member and secured to the second upright I-bar for connecting the at least one second transverse member to the second upright I-bar, a first linear actuator connected to the overhead door and the at least one first transverse member, and a second linear actuator connected to the overhead door and the at least one second transverse member, said first linear actuator and said second linear actuator being concurrently operable to selectively move the overhead door relative to the frame between the upright closed position and the generally horizontal open position.

2. The overhead door and frame of claim 1 wherein:

the at least one first transverse member comprises a pair of first transverse members secured together in a generally right angle relation, the at least one first rib comprising a pair of first ribs secured to the pair of first transverse members and the first upright I-bar for connecting the pair of first transverse members to the first I-bar, the at least one second transverse member comprising a pair of second transverse members secured together in a generally right angle relation, and the at least one second rib comprising a pair of second ribs secured to the pair of second transverse members and the second upright I-bar for connecting the pair of second transverse members to the second I-bar.

3. The overhead door and frame of claim 1 including:

a plurality of first horizontal members secured to the first upright tubular column, the second upright tubular column and the first upright I-bar for connecting the first upright tubular column and the second upright tubular column to the first upright I-bar, and a plurality of second horizontal members secured to the third upright tubular column, the fourth upright tubular column and the second upright I-bar for connecting the third upright tubular column and the fourth upright tubular column to the second upright I-bar.

4. The overhead door and frame of claim 3 wherein:

the plurality of first horizontal members comprise a plurality of horizontal first plates, and the plurality of second horizontal members comprising a plurality of horizontal second plates.

5. The overhead door and frame of claim 1 wherein:

the first base includes a first front corner section, a second front corner section laterally spaced from the first front corner section and a first middle rear section, the first upright tubular column being secured to the first front corner section of the first base, the second upright tubular column being secured to the second front corner section of the first base, the first upright I-bar being secured to the first middle rear section of the first base, the second base including a third front corner section, a fourth front corner section laterally spaced from the third front corner section and a second middle rear section, the third upright tubular column being secured to the third front corner section of the second base, the fourth upright tubular column being secured to the fourth front corner section of the second base, and the second upright I-bar being secured to the second middle rear section of the second base.

6. The overhead door and frame of claim 5 including:

a plurality of first horizontal members secured to the first upright tubular column, the second upright tubular column and the first upright I-bar, and a plurality of second horizontal members secured to the third upright tubular column, the fourth upright tubular column and the second upright I-bar.

7. The overhead door and frame of claim 6 wherein:

the plurality of first horizontal members comprise a plurality of horizontal first plates, and the plurality of second horizontal members comprising a plurality of horizontal second plates.

8. The overhead door and frame of claim 1 including:

a first connecting device secured to the at least one first transverse member and connected to the first linear actuator, and a second connecting device secured to the at least one second transverse member and connected to the second linear actuator.

* * * * *